United States Patent [19]

Savit

[11] 4,228,634

[45] Oct. 21, 1980

[54] ENVELOPE OPENING PROCESS AND COMPOSITION

[75] Inventor: Joseph Savit, Glencoe, Ill.

[73] Assignee: AES Technology Systems, Inc., Elk Grove Village, Ill.

[21] Appl. No.: 65,908

[22] Filed: Aug. 13, 1979

[51] Int. Cl.[3] ..... B65B 43/26; B65B 69/00

[52] U.S. Cl. ..... 53/492; 53/381 R; 53/381 A; 156/247; 252/1; 252/142

[58] Field of Search ..... 252/1, 142; 156/247; 53/492

[56] References Cited

U.S. PATENT DOCUMENTS

| | | | |
|---|---|---|---|
| 3,677,460 | 7/1972 | Whitman | 53/381 R |
| 3,816,213 | 6/1974 | Whitman | 53/381 R |
| 3,871,573 | 3/1975 | Whitman | 53/381 R |
| 4,082,603 | 4/1978 | McPherson | 53/381 R |
| 4,181,623 | 1/1980 | Dillarstone | 252/142 |
| 4,189,341 | 2/1980 | McPherson et al. | 53/381 R |

*Primary Examiner*—Edward M. Woodberry

*Attorney, Agent, or Firm*—Dressler, Goldsmith, Shore, Sutker & Milnamow, Ltd.

[57] ABSTRACT

In an envelope opening process in which an aqueous solution of a chemical degradation agent, such as tartaric acid is applied to envelope edges and the envelope edges are then heated and subjected to a mild mechanical action, penetration of the degradation agent through the envelope paper at its edges is assured by including in the aqueous solution from 2.5% to 30% of a glycol ether, such as ethylene glycol ethyl ether.

8 Claims, No Drawings

ENVELOPE OPENING PROCESS AND COMPOSITION

DESCRIPTION

Background of the Invention

In organizations receiving large amounts of mail, the opening of envelopes constitutes a substantial burden. To deal with this burden, mechanical envelope openers have been used which operate by cutting a thin strip from one edge of each envelope. Such openers sometimes damage the envelope contents because of variations in envelope size and the manner in which the contents are stuffed in the envelopes. Mechanical openers also produce large volumes of paper shavings from the high speed cutting of envelopes.

It has also been proposed to open envelopes by processes involving the chemical degradation of paper, and specifically of its cellulose, at at least one edge of the envelopes, and preferably at three edges thereof, followed by mild mechanical action to remove the degraded paper.

Zacker U.S. Pat. No. 2,866,589 discloses the degradation of cellulosic paper envelopes at their edges by chemical reagents, specifically by the action of nitric acid, sodium hydroxide, or sodium hypochlorite, or by the action of sulfuric acid followed by the application of heat.

Whitman U.S. Pat. No. 3,871,573 teaches the utilization of successive applications to the edges of an envelope of a sodium alkyl sulfate (sensitizing agent) and an organic acid, such as oxalic acid or acetic acid (developing agent), followed by the application of heat. Gunther, Jr. U.S. Pat. No. 4,069,011 discloses a similar system, utilizing tartaric acid in combination with the sodium alkyl sulfate. These systems produce sulfuric acid in situ.

Savit U.S. patent application Ser. No. 946,347, filed Sept. 27, 1978 now U.S. Pat. No. 4194342 issue Mar. 25, 1980, and coassigned herewith, teaches that a non-noxious organic acid having at least one pK value at room temperature between about 1.4 and about 5 may be used as the sole reactant with cellulose in the presence of heat to degrade an envelope edge so that it may be opened by mild mechanical action. Tartaric acid is the preferred organic acid.

In chemical degradation processes utilizing a liquid phase chemical degradation agent, it is important that the degradation agent be in contact with the cellulose where degradation is desired and not in contact with the cellulose where degradation is not desired. For envelope opening, this means that degradation agent applied to the envelope edges should penetrate and pass through the thickness of the folded paper but should not spread laterally to areas beyond the edges to which the liquid has been applied.

The above cited Zacker patent does not discuss the problem of controlling the geometry of the zone of cellulose-degradation agent contact. Nor does the above cited Gunther patent.

The above cited Whitman patent does not discuss the aforementioned problem of contact geometry but discloses isopropanol as a sensitizing agent solvent, optionally mixed with about 10% of water. Isopropanol, as discussed below, has excellent penetrating properties and helps to carry a solution of degradation agent through the thickness of an envelope edge without excessive lateral spread to areas of the envelope to which the solution has not been applied. Whitman does not disclose isopropanol as a solvent or solvent component for his developing agent (organic acid).

The above cited Savit patent application discloses that a solvent system comprising 70 volume percent of water and 30 volume percent of isopropanol enables a tartaric acid degradation agent to penetrate into and through the paper at the edges of an envelope.

The water-isopropanol solvent of the aforementioned Savit patent application is effective with respect to providing penetration for the tartaric acid degradation agent but it has the disadvantage of constituting a flammability and explosion hazard. Water and isopropanol form an azeotrope more volatile than either of its components; and mixtures of these materials have a relatively low flash point. Care must be exercised in the use of such mixtures in envelope opening processes and government regulations require suitable warning labels on such mixtures.

BRIEF SUMMARY OF THE INVENTION

In accordance with the instant invention, the isopropanol penetrating agent of the aforementioned Savit patent application is replaced by from about 2.5 to about 30 volume percent of a glycol ether of the formula:

$$R_1(OR_2)_nOH$$

wherein $R_1$ is an alkyl group having from 1 to 4 carbon atoms, $R_2$ is an alkylene group having 2 to 3 carbon atoms and n is an integer from 1 to 2, said glycol ether being capable when applied to one surface of a sheet of envelope paper in a standard penetration test in a solution of 80 volume percent of water and 20 volume percent of said glycol ether in a drop of 0.05 ml. size at ambient temperature, of penetrating to the opposite surface within one minute without spreading on said one surface to an area having a diameter in excess of 10 millimeters, said envelope paper being of White Wove starch-sized envelope stock having a moisture content of about 5%, having a basic weight of $22\pm2$ pounds per 3000 square feet and a caliper of $0.0045\pm0.0005$ inches.

Within the aforesaid range of volumetric proportions between the glycol ether and water, the higher portion of the range (from about 15 to about 30 volume percent) is preferred for glycol ethers, such as ethylene glycol monoethyl ether, which have normal boiling points below 180° C.; and the lower portion of the range (from about 2.5 to about 15 volume percent) is preferred for glycol ethers, such as diethylene glycol monobutyl ether, which have normal boiling points above 180° C.

The preferred glycol ether is ethylene glycol monoethyl ether, sold by Union Carbide Corporation under the trademark "Cellosolve", sold by Shell Chemical Company under the trademark "Oxitol", and sold by Dow Chemical Company, Eastman Kodak Corporation, Olin-Matheson Corporation and Jefferson Chemical Company under the trademarks "Dowanol EE", "Ektasolve EE", "Poly-Solv EE", and "Jeffersol EE", respectively.

Ethylene glycol monoethyl ether is miscible with water in all proportions. It does not constitute a toxicity hazard in ordinary handling. The pure compound has a flash point of 140° F. (60° C.), but water solutions containing from about 2.5 to about 30 volume percent of the gylcol ether have flash points high enough so that the solutions do not constitute an explosive hazard and need not be labelled as such. Other glycol ethers utilizable in accordance with this invention also have higher flash points in aqueous solutions within the aforementioned concentrations than isopropanol and are thus also less subject than isopropanol to explosion hazard when used in accordance with this invention.

The glycol ether-water solvent systems, used in accordance with the instant invention for their paper penetrating power, may be used with any cellulose degradation agent. They may be used, for example, with the chemical degradation agents for cellulose disclosed in the aforementioned Zacker patent. They may also be used in the systems of the above cited Whitman patent, as solvent for the sensitizing agent, for the developing agent, or for both. In the preferred systems of the instant invention, however, the cellulose degradation agents are those disclosed in the aforementioned Savit application, and most preferably tartaric acid.

Most preferably, the glycol ether-water combinations are used as solvent systems for solutions containing tartaric acid at a concentration of about 3 normal and optionally containing a minor amount (about one drop per 100 cc.) of a fluorinated surfactant. However, the concentration of tartaric acid, or other non-noxious organic acid having at least one pK value at room temperature between about 1.4 and about 5, may vary from about 0.5 to about 7 normal; and a preferable range is from about 2 to about 4 normal.

As disclosed in the aforementioned Savit patent application, the strength of the acid in the solution may be varied within broad limits. Tartaric acid is soluble in aqueous solutions at room temperature up to about 7 normal, but increased concentration above about 3 normal does not appear to improve the effect of the solution in the chemical degradation of cellulose. Furthermore, highly concentrated tartaric acid solutions tend to clog spray nozzles when the acid solution is applied by spray and tend to corrode equipment. At the lower end of the range, concentrations as low as about 0.5 normal may be used, but are not as effective as 3 normal and require longer heating periods and/or higher temperatures in the heating step. Since the solvent of the organic acid solution evaporates when the envelope edge is heated, dilute solutions, if not effective per se, concentrate to solutions which are effective.

The acid solution containing the glycol ether penetration agent is preferably applied to the envelope edges while the envelopes are clamped, or held, together in stacks so that the edges of a plurality of envelopes define a plane.

The organic acid solution containing the glycol ether penetration agent is preferably applied to the edges of the stacked envelopes in the form of a spray applied through spray nozzles in a manner known in the art. The acid solution may also be applied to the edges of the stacked envelopes by the operation of brushes or rollers, or by dipping the edges into a shallow pan containing the solution.

The organic acid solution containing the glycol ether penetration agent is generally applied to the envelope edges while both the solution and the envelope edges are at room temperature. The effectiveness of the penetration agent makes it unnecessary, in most instances, to preheat the solution, or the envelope edges, or both, to facilitate penetration of the solution into the paper at the envelope edges. However, for very high production rates and short contact times, elevated temperatures may be beneficial.

After the organic acid solution containing the glycol ether penetration agent is applied to the envelope edges, the edges are heated to dry the solution and to promote the degradation of the cellulose making up the paper edges. Heat may be applied by direct contact of the envelope edges with a heated surface, by close proximity of the envelope edges to a source of radiant heat, by directing a heated air stream against the envelope edges, or by inserting and maintaining the stacked envelopes in an oven. In the last named case, the heating is, of course, general, covering the entire envelope and its contents; and this method is not preferred.

The temperature obtained on the outer surface of the envelope edges remains relatively low as long as there is solvent thereon by reason of the cooling effect of the solvent evaporation. After the solvent has evaporated the temperature at the outside of the envelope edges may range from about 80° C. to just below the temperature at which the paper would ignite. Most envelopes are made of starch-filled papers; and the edges of envelopes made of such papers may be heated to temperatures as high as 230° C. without igniting. Within the foregoing range, the desired chemical degradation will, or course, proceed much more quickly at higher temperatures than at the lower end of the range.

The temperature at the envelope edges may be measured, if desired, by an optical pyrometer, or other remote temperature measuring device by techniques known in the art. Temperatures may also be measured at the heating plate or heating strip when the heat is applied to the envelope edges by direct contact with such a plate or strip. However, precise temperature control is not essential, except when temperatures close to the ignition temperature are employed.

After the heating step, the edges of the stacked envelopes are subjected to a mild mechanical action to remove the degraded and embrittled cellulose and thereby unseal the edges. The mild mechanical action may be by abrasion, as with a brush or wheel, or may be by the action of a high velocity air stream. The mechanical action may be combined with, and simultaneous with, the heating step when heat is applied by a moving heated surface in contact with the envelope edge.

The process of this invention may be applied to only one edge of each rectangular envelope. It may also be applied to two, three, or all four edges. Preferably, it is applied to three edges, leaving intact either the edge joining the envelope flap to the envelope body or the edge opposite the flap.

In most instances, the removal of envelope contents from envelopes opened as described above will be a manual or automatic operation on each individual envelope. This is necessary because in most cases it is desired to be able to relate an envelope with its contents, if necessary.

EXAMPLES

A series of test solutions was prepared, each containing 0.225 kg. of tartaric acid and 0.5 cc. of a fluorinated surfactant per liter of an aqueous solvent containing the following liquids to be tested as penetrants in the volume percentages shown:

| Solution | Material Tested | Percentage |
|---|---|---|
| A | isopropyl alcohol | 25 |
| B | ethylene glycol ethyl ether | 25 |
| C | ethylene glycol ethyl ether | 30 |

-continued

| Solution | Material Tested | Percentage |
|---|---|---|
| D | ethylene glycol ethyl ether | 20 |
| E | ethylene glycol ethyl ether | 15 |
| F | diethylene glycol butyl ether | 25 |
| G | diethylene glycol butyl ether | 20 |
| H | diethylene glycol butyl ether | 15 |
| I | diethylene glycol butyl ether | 10 |
| J | diethylene glycol butyl ether | 5 |
| K | diethylene glycol butyl ether | 2.5 |
| L | none (control) | 0 |
| M | dipropylene glycol methyl ether | 5 |
| N | dipropylene glycol methyl ether | 10 |
| O | dipropylene glycol methyl ether | 15 |
| P | dipropylene glycol methyl ether | 20 |
| Q | dipropylene glycol methyl ether | 25 |
| R | diethylene glycol ethyl ether - special grade | 5 |
| S | diethylene glycol ethyl ether - special grade | 10 |
| T | diethylene glycol ethyl ether - special grade | 15 |
| U | diethylene glycol ethyl ether - special grade | 20 |
| V | diethylene glycol ethyl ether - special grade | 25 |

For test purposes and to determine the effectiveness of the cellulose degradation at an envelope edge, a test device was constructed. The device comprised a spring dynamometer suspended from a firm base, having a horizontal bar suspended at one of its ends from the lower end of the dynamometer and a vertical bar suspended from the opposite end of the horizontal bar.

In the testing, a side of each test envelope was slit open and the interior of the envelope was placed over the horizontal bar, with the horizontal bar lying just under the interior of one uncut edge of the envelope and the vertical bar lying adjacent the interior of another uncut edge.

About 0.025 cc. of one of the test solutions listed above was then applied to the upper edge of each envelope (the side above the horizontal bar) for a period of 10 seconds and the upper edge was then heated by contact with a heating plate, or strip, for a period of 15 seconds to a plate temperature shown in Table I below.

After the heating step, the envelope was pulled downwardly by hand until the upper edge opened and the envelope slipped off the device while the readings on the dynamometer at the instant of opening were observed. Tests in which the treated envelope edge opened under a dynamometer reading of 500 grams or less were considered to be successful with respect to the achievement of ease of opening.

TABLE I

All of the Examples in Table I were carried out on envelopes from the same source (Corrasable).

| Ex. | Sol. | Temp. (°F.) | Opening Force(gm) | Comments |
|---|---|---|---|---|
| 1 | A | 450 | 0 | opened easily |
| 2 | A | 400 | 300 | opened easily |
| 3 | A | 350 | 500 | opened easily |
| 4 | A | 300 | 500+ | did not open |
| 5 | B | 450 | 0 | opened on plate |
| 6 | B | 400 | 500 | edge was diffuse |
| 7 | B | 400 | 500 | opened easily |
| 8 | B | 350 | 500 | opened easily - wet sides |
| 9 | B | 300 | 500+ | did not open |

TABLE II

All of the Examples in Table II were carried out on envelopes from a second source (Town and Country).

| Ex. | Sol. | Temp. (°F.) | Opening Force(gm) | Comments |
|---|---|---|---|---|
| 10 | A | 400 | 200 | opened easily |
| 11 | B | 400 | 100 | opened easily |
| 12 | A | 350 | 500+ | did not open |
| 13 | B | 350 | 500+ | did not open |

TABLE III

In Table III, Solutions A and B were compared with respect to their action on envelopes from five different sources, Examples 14, 16, 18, 20 and 22 being run with Solution A on each of the different envelopes and Examples 15, 17, 19, 21 and 23 corresponding, respectively, except they are run with Solution B.

| Ex. | Sol. | Temp. (°F.) | Opening Force(gm) | Comments |
|---|---|---|---|---|
| 14 | A | 400 | 150 | opened easily |
| 15 | B | 400 | 150 | opened easily |
| 16 | A | 400 | 500 | opened easily |
| 17 | B | 400 | 350 | opened easily |
| 18 | A | 400 | 350 | opened easily |
| 19 | B | 400 | 400 | opened easily |
| 20 | A | 400 | 0 | opened easily |
| 21 | B | 400 | 0 | opened easily |
| 22 | A | 400 | 300 | opened easily |
| 23 | B | 400 | 250 | opened easily |

TABLE IV

In Table IV, Solution A with isopropanol is compared to Solutions B, C, D and E containing different levels of ethylene glycol ethyl ether.

| Ex. | Sol. | Temp. (°F.) | Opening Force(gm) | Comments |
|---|---|---|---|---|
| 24 | A | 450 | 0 | opened on plate |
| 25 | A | 400 | 50 | opened easily |
| 26 | A | 350 | 350 | opened easily |
| 27 | A | 300 | 500+ | did not open |
| 28 | B | 450 | 0 | opened on plate |
| 29 | B | 400 | 0 | opened easily |
| 30 | B | 350 | 450 | opened easily |
| 31 | B | 300 | 500+ | did not open |
| 32 | C | 450 | 0 | opened easily |
| 33 | C | 400 | 500 | opened easily |
| 34 | C | 350 | 500+ | did not open |
| 35 | C | 300 | 500+ | did not open |
| 36 | D | 450 | 0 | opened on plate |
| 37 | D | 400 | 0 | mostly opened on plate |
| 38 | D | 350 | 250 | opened easily |
| 39 | D | 300 | 500 | opened |
| 40 | D | 300 | 500+ | did not open |
| 41 | E | 450 | 0 | opened on plate |
| 42 | E | 400 | 0 | opened easily |
| 43 | E | 350 | 500 | opened |
| 44 | E | 350 | 500 | opened |
| 45 | E | 300 | 500+ | did not open |

TABLE V

In Table V, diethylene glycol butyl ether, at several levels of concentration, is compared with isopropanol and ethylene glycol ethyl ether as controls.

| Ex. | Sol. | Temp. (°F.) | Opening Force(gm) | Comments |
|---|---|---|---|---|
| 46 | F | 450 | 50 | opened easily |
| 47 | F | 400 | 500 | opened easily |
| 48 | F | 350 | 500 | opened easily |
| 49 | F | 300 | 500 | opened easily |
| 50 | F | 350 | 450 | opened easily |
| 51 | F | 400 | 125 | opened easily |
| 52 | G | 450 | 150 | opened easily |
| 53 | G | 400 | 500+ | did not open |
| 54 | G | 350 | 500 | opened easily |
| 55 | G | 300 | 500+ | did not open |
| 56 | G | 350 | 450 | opened easily |
| 57 | H | 450 | 0 | opened easily |
| 58 | H | 400 | 450 | opened easily |
| 59 | H | 350 | 500+ | did not open |
| 60 | H | 300 | 500+ | did not open |
| 61 | I | 450 | 300 | opened easily |
| 62 | I | 400 | 500 | opened easily |
| 63 | I | 350 | 350 | opened easily |
| 64 | I | 400 | 500+ | did not open |
| 65 | A | 350 | 200 | opened easily |
| 66 | D | 350 | 500 | opened easily |
| 67 | D | 350 | 400 | opened easily |

In Examples 46 to 49 the envelopes wetted very well, but the paper had a muddy appearance.

TABLE VI

In Table VI, diethylene glycol butyl ether at several levels of concentration lower than those of Table V is compared with isopropanol and ethylene glycol ethyl ether as controls.

| Ex. | Sol. | Temp. (°F.) | Opening Force(gm) | Comments |
|---|---|---|---|---|
| 68 | A | 300 | 500+ | did not open |
| 69 | A | 350 | 500 | opened easily |
| 70 | A | 400 | 500 | opened easily |
| 71 | A | 450 | 0 | opened on plate |
| 72 | B | 450 | 0 | opened on test unit |
| 73 | B | 400 | 0 | opened on test unit |
| 74 | B | 350 | 500 | borderline |
| 75 | B | 350 | 500 | opened easily |
| 76 | B | 350 | 500 | opened easily |
| 77 | B | 350 | 500+ | did not open |
| 78 | L | 450 | 0 | opened easily |
| 79 | L | 400 | 500 | opened easily - borderline |
| 80 | L | 350 | 500 | opened easily - borderline |
| 81 | L | 300 | 500+ | did not open |
| 82 | K | 450 | 0 | opened on plate |
| 83 | K | 400 | 500 | opened easily |
| 84 | K | 350 | 500 | opened easily |
| 85 | K | 300 | 500+ | did not open |
| 86 | J | 450 | 0 | opened on test unit |
| 87 | J | 400 | 0 | opened on test unit |
| 88 | J | 350 | 400 | opened easily |
| 89 | J | 300 | 500 | did not open |

In Examples 78 to 81, using a water solvent without a penetrating agent, there was poor penetration with the solution wetting the outside of the envelope, only. The wetting in Examples 82–85, with 2.5% of penetrating agent, the wetting was somewhat better; and the wetting in Examples 86–89, with 5% of penetrating agent, the wetting was still better.

TABLE VII

In Table VII dipropylene glycol methyl ether was tested at various concentrations and diethylene glycol ethyl ether special grade was tested at 25% against ethylene glycol ethyl ether as a control and against a solution with no penetrating agent as a second control. The wetting of the envelope at its edge was observed.

| Ex. | Sol. | Temp. (°F.) | Opening Force(gm) | Edge Wetting | Comments |
|---|---|---|---|---|---|
| 90 | B | 400 | 500 | good | control |
| 91 | B | 350 | 500+ | | did not open |
| 92 | B | 350 | 500 | | opened easily |
| 93 | L | 400 | 500 | no penetrating | did not open |
| 94 | L | 350 | 500+ | | did not open |
| 95 | L | 400 | 500 | | borderline opened easily |
| 96 | M | 400 | 300 | some penetration | |
| 97 | M | 350 | 500 | | borderline opened easily |
| 98 | M | 350 | 500+ | | did not open |
| 99 | N | 400 | 150 | good penetration | opened easily |
| 100 | N | 350 | 500+ | | did not open |
| 101 | N | 350 | 500 | | did not open |
| 102 | O | 400 | 25 | good penetration | opened easily |
| 103 | O | 350 | 500+ | | did not open |
| 104 | O | 350 | 500+ | | did not open |
| 105 | P | 400 | 0 | good penetration | opened easily |
| 106 | P | 350 | 500 | | borderline opened easily |
| 107 | P | 350 | 500+ | | did not open |
| 108 | Q | 400 | 375 | best penetration | opened easily |
| 109 | Q | 350 | 500 | | opened easily |
| 110 | Q | 350 | 500 | | borderline opened easily |
| 111 | V | 400 | 425 | maybe some penetration | opened easily |
| 112 | V | 350 | 500+ | | did not open |

A series of penetration tests were run in which a drop (0.05 ml.) of an aqueous solution of the material to be tested as a penetrating agent (in a concentration to be tested) was placed on one surface of a piece of envelope paper and observations were made as to the penetration of the drop through the paper and the spread of the drop on the side to which it was applied. The envelope paper was made of a White Wove starch-sized stock having a moisture content of about 5%, having a basic weight of 22±2 pounds per 3000 square feet and a caliper of 0.0045±0.0005 inches. The paper was dark red colored on its inner surface (opposite the surface to which the drop was applied) so that penetration through the paper would be more easily seen.

The results are shown in Table VIII.

TABLE VIII

| Example | Solution | Time to End Point (Complete Penetration) | Drop Diameter (mm) | Underface Results |
|---|---|---|---|---|
| 113 | A | 1 sec. or less | 15 | dry |
| 114 | E | not there at 5 min. | 5 | wet |
| 115 | D | 3 min. | 10 | wet |
| 116 | D | some red at 2 min. | 7 at 1 min. | wet at 1 min. |
| 117 | E | very slight red at 1 min. | 5 at 1 min. | slightly wet at 1 min. |
| 118 | A | 5–10 sec. | 11 at 1 min. | fairly wet at 1 min. |
| 119 | C | 5 sec. | 14 | wet |
| 120 | B | 10–15 sec. | 12 | wet |
| 121 | L | no color | 5 | not wet |

-continued

| Example | Solution | Time to End Point (Complete Penetration) | Drop Diameter (mm) | Underface Results |
|---|---|---|---|---|
| 121 | K | slight color | 7 | fairly wet |
| 122 | J | 5 sec. | 15 | wet |
| 123 | I | 2 sec. | 18 | wet |
| 124 | H | 2 sec. | 18 | fairly wet |
| 125 | G | 2 sec. | 17 | more wet |
| 126 | F | 3 sec. | 16 | some damp |

TABLE IX

In the Examples listed in Table IX the procedure described with respect to the Examples in Table VIII were repeated, except that the time of contact was standardized to one minute and the drop diameters were not recorded for solutions which were not effective for penetration within one minute.

| Example | Solution | Penetration | Drop Diameter (mm) |
|---|---|---|---|
| 127 | M | no penetration | — |
| 128 | N | none to slight - no color | — |
| 129 | O | slight pink color | 6 |
| 130 | P | definite pink color | 13 |
| 131 | Q | dark pink color | 13 |
| 132 | R | no penetration | — |
| 133 | S | no penetration | — |
| 134 | T | no penetration | — |
| 135 | U | no penetration | — |
| 136 | V | no penetration | — |
| 137 | L | no penetration | — |
| 138 | B | definite pink color | 9 |

The standard penetration test described above differs from the tests of Tables VIII and IX in that the solutions in the standard test do not contain tartaric acid or fluorinated surfactant and in that time for penetration and concentration of penetrating agent are fixed in the standard test for permitting direct comparisons.

The foregoing data (particularly the strip heater tests of Tables I, II and III) show that ethylene glycol ethyl ether is at least as effective as isopropyl alcohol as a penetrating agent for a cellulose degradation solution containing tartaric acid. The data in Table IV shows that ethylene glycol ethyl ether is most effective at a concentration of 25 volume percent. The data in Tables V and VI show that diethylene glycol butyl ether is also effective as a penetrating agent and optimum at a concentration of 5 volume percent. The data in Table VII show that dipropylene glycol methyl ether is somewhat effective as a penetrating agent and optimum at 20 volume percent. Even at its optimum, dipropylene glycol methyl ether is not as effective as ethylene glycol ethyl ether; and the penetration tests of Table IX show that it permits too great a lateral spread of the solution to be acceptable.

Solutions B and J were compared directly on envelopes from 20 different sources in the envelope opening test described above, the heating temperature being set at 350° F. in these tests. In the envelopes treated with Solution J the average opening force was 321.4 gm. and 30% of the envelopes did not open easily. The average opening force for the envelopes treated with Solution B was 242.9 gm. and only 5% of the envelopes failed to open easily. Ethylene glycol ethyl ether at its optimum level of 25 volume percent proved to be superior to diethylene glycol butyl ether at its optimum level of 5 volume percent with respect to effectiveness on randomly selected envelopes.

A similar comparison was made between Solution B and Solution P on envelopes from 20 sources different from each other and different from the sources in the tests described in the last paragraph. In this series, the heater temperature was 400° F., except for the envelopes from one source where the test was carried out with both solutions at a heater temperature of 350° F. Of the envelopes treated with Solution P, the lowest 15, with respect to opening force, averaged 315 gm. Of those treated with Solution B, the lowest 15 averaged 260 gm. 25% of the envelopes treated with Solution P did not open easily, but only 5% of the envelopes treated with Solution B did not open easily. The standard deviation with respect to opening force was 136 for Solution P and 105 for Solution B.

From the just described tests it was concluded that ethylene glycol ethyl ether at its optimum level of 25 volume percent was more effective as a penetrant than dipropylene glycol methyl ether at its optimum level of 20 volume percent.

Diethylene glycol ethyl ether-special grade as a penetrating agent (Solution V) is only slightly more effective than no penetrating agent at all (Solution L), as shown in the data in Table VII and its penetrating power in direct penetration testing is quite poor, as shown in the data in Table IX.

The invention has been described with respect to its preferred embodiments. It will be understood by those skilled in the art that variations and modifications may be made without departing from the essence of this invention.

What is claimed is:

1. In the process for opening envelopes made of cellulosic paper in which a chemical degradation agent for cellulose in aqueous solution is applied to at least one edge of said envelopes, said edge is thereafter heated and subjected to mild mechanical action, the improvement wherein said aqueous solution contains from about 2.5 to about 30 volume percent of a glycol ether of the formula $$R_1(OR_2)_nOH$$

wherein $R_1$ is an alkyl group having from 1 to 4 carbon atoms, $R_2$ is an alkylene group having 2 to 3 carbon atoms and n is an integer from 1 to 2, said glycol ether being capable, when applied to one surface of a sheet of envelope paper in a solution of 80 volume percent of water and 20 volume percent of said glycol ether in a drop of 0.05 ml. size at ambient temperature, of penetrating to the opposite surface within one minute without spreading on said one surface to an area having a diameter in excess of 10 millimeters, said envelope paper being of White Wove starch-sized envelope stock having a moisture content of about 5%, having a basic weight of 22±2 pounds per 3000 square feet and a caliper of 0.0045±0.0005 inches.

2. The process of claim 1 wherein said glycol ether is ethylene glycol monoethyl ether.

3. The process of claim 1 wherein said glycol ether is diethylene glycol monobutyl ether.

4. The process of claim 1 wherein said chemical degradation agent is a non-noxious organic acid having at least one pK value at room temperature between about 1.4 and about 5.

5. The process of claim 1 wherein said chemical degradation agent is tartaric acid.

6. In the process for opening envelopes made of cellulosic paper in which an aqueous solution of tartaric acid is applied to at least one edge of said envelopes as the sole reactant with cellulose and said edge is thereafter heated and subjected to mild mechanical action, the improvement wherein said solution contains from about 15 to about 30 volume percent of ethylene glycol monoethyl ether.

7. A composition for the chemical degradation of paper comprising tartaric acid at a concentration between about 0.5 normal and 7 normal dissolved in a solvent comprising from about 15 to about 30 volume percent of ethylene glycol monoethyl ether and from about 70 to about 85 volume percent of water.

8. The composition of claim 7 wherein said tartaric acid concentration is about 3 normal and wherein said solvent comprises about 25 volume percent of ethylene glycol monoethyl ether and about 75 volume percent of water.

* * * * *